US006321636B1

(12) United States Patent
Fritz et al.

(10) Patent No.: US 6,321,636 B1
(45) Date of Patent: Nov. 27, 2001

(54) PISTON ROD-LESS PNEUMATIC CYLINDER

(75) Inventors: Erhard Fritz, Königsbach/Stein; Peter Rohatschek, Metzingen, both of (DE)

(73) Assignee: Hygrama AG, Rotkrenz (CH)

( * ) Notice: Subject to any disclaimer, the term of this patent is extended or adjusted under 35 U.S.C. 154(b) by 32 days.

(21) Appl. No.: 09/343,415

(22) Filed: Jun. 30, 1999

(30) Foreign Application Priority Data

Jul. 1, 1998 (AT) ..... 442/98 U

(51) Int. Cl.[7] ..... F01B 29/00
(52) U.S. Cl. ..... 92/88
(58) Field of Search ..... 92/88; 277/345

(56) References Cited

U.S. PATENT DOCUMENTS

Re. 34,049 * 9/1992 Taki et al. ..... 92/88
4,685,383 * 8/1987 Ruchser ..... 92/88
4,991,494 * 2/1991 Migliori ..... 92/88
5,317,957 * 6/1994 Miyamoto ..... 92/88
5,467,686 * 11/1995 Lipinski ..... 92/88
5,517,901 * 5/1996 Lipinski ..... 92/88
5,996,569 * 12/1999 Green ..... 92/88

* cited by examiner

*Primary Examiner*—John E. Ryznic
(74) *Attorney, Agent, or Firm*—Dykema Gossett PLLC

(57) ABSTRACT

In a piston rod-less pneumatic cylinder, the longitudinal slot (1) is sealed from the inside on either side of the piston with a sealing tape (3) which exhibits fixing elements (9) that engage a fixing edge (10) provided on the cylinder with a positive fit to secure the sealing tape (3) given an unpressurized interior. This ensures a reliable sealing of the interior even in an unpressurized state, and prevents leaks from starting when a previously unpressurized interior is pressurized.

10 Claims, 2 Drawing Sheets

PISTON ROD-LESS PNEUMATIC CYLINDER

BACKGROUND OF THE INVENTION

1. Field of the Invention

The invention relates to a piston rod-less pneumatic cylinder, that includes a piston longitudinally movable inside a cylinder tube and a transmission element that engages with this piston and projects out through a longitudinal slot in the cylinder tube, along with a sealing tape that seals the longitudinal slot from the inside on either side of the piston, which is routed through the piston in the area of the transmission element, and includes a sealing strip that interacts with two longitudinally-extending sealing areas near the end of the longitudinal slot inside the cylinder, along with at least one fixing strip arranged on the outside of the sealing strip with two fixing elements that lie opposite one another relative to the center plane of the longitudinal slot, and are essentially longitudinally extended and directed toward the outside.

Pneumatic cylinders of the above kind are mostly pneumatically actuated and, due to their piston rodless design, have come to be preferred for use in areas where small fitting length is important. The force exerted on the piston by the pressure medium is conveyed from the transmission element that engages with the piston and projects out through the lateral longitudinal slot to the device to be operated. The delivery chambers lying on either side of the piston are sealed off by packing rings or the like on the piston, and also by the sealing tape covering the longitudinal slot, which is routed toward the inside under the transmission element in the unpressurized area between the piston seals.

2. The Prior Art

The operating pressure prevailing in the respective delivery chamber during actuation of the pneumatic cylinder presses the sealing tape from the inside against the two longitudinally extended sealing areas in the area of the end of the longitudinal slot inside the cylinder, forming a seal. In an unpressurized state, however, precautions must in most instances be taken to prevent the sealing tape from sagging into the cylinder, since at least a temporary leak will otherwise arise during pressurization with the pressure medium. For this reason, one design for a pressure cylinder of the kind mentioned at the outset, e.g., as known from EP 82 829 B1, provides for outwardly directed, longitudinally-extended fixing elements that flexibly press outwardly against the side walls of the longitudinal slot, thereby using clamping and friction forces to bring about a non-positive fit of the sealing tape in the longitudinal slot. EP 147 803 B1 also discloses a similar design, in which the central area of the side walls of the longitudinal slot exhibits rebounding recesses that are expanded relative to accompanying longitudinally extended, projecting fixing lips on the fixing strip of the sealing tape. As a result, the sealing tape is here finally held in a non-positive manner in the longitudinal slot of the cylinder tube by clamping and frictional forces.

In both mentioned known arrangements, in particular in applications involving exposure to strong vibrations or the like, for example, there is a danger that the sealing tape on the unpressurized side will still sag into the cylinder, as a result of which the described initial leaks can become noticeable in a correspondingly disruptive fashion during pressurization. The object of this invention is to avoid the mentioned disadvantages to known arrangements, in particular to design a pneumatic cylinder of the kind discussed at the outset in such a way as to ensure that the sealing tape will hold better in the longitudinal slot using simple means, even in an unpressurized state.

SUMMARY OF THE INVENTION

The object is achieved according to the invention in a pneumatic cylinder of the kind mentioned at the outset by having the fixing elements of the fixing strip engage the fixing edge provided on the cylinder with a positive fit to hold the sealing tape in the longitudinal slot. This makes it very easy to ensure that the sealing strip or its sealing areas always interact with the accompanying longitudinally extended sealing areas around the interior cylinder end of the longitudinal slot even on the unpressurized side. As a result, the longitudinal slot is already sealed as pressurization of the respective cylinder side begins, and the described leaks virtually become no longer discernible.

In a preferred embodiment of the invention, the fixing edges can be formed on the longitudinal slot of the cylinder tube itself. On the one hand, this simplifies the manufacture of cylinder tubes, which are today most often extruded out of aluminum, and of the fixing strip of the sealing tape. On the other hand, this makes it relatively easy to engage or disengage the joint holding the sealing tape in the longitudinal slot.

In another advantageous embodiment of the invention, the fixing edges can also be arranged on separate fixing grooves of the cylinder tube provided on the interior on either side, essentially parallel next to the longitudinal slot. This permits the greatest variety of potential configurations for these fasteners and, for example, leaves the longitudinal slot available as a lateral support for the projecting transmission element.

In another preferred embodiment of the invention, the fixing edges can also be provided on an outer band that at least partially covers the longitudinal slot from outside. This simplifies the cylinder tube profile and its manufacture, since it shifts the corresponding measures to the area of the outer band.

In a further embodiment of the invention, the fixing edges can be formed directly by the outside edges of the longitudinal slot. This also enables a very easy forming of the cylinder tube profile while and a simultaneous reliable fixing or anchoring of the sealing tape.

In a further embodiment of the invention, the fixing edges formed on the longitudinal slot of the cylinder tube itself can be designed as fixing grooves provided on both sides of the side walls of the longitudinal slot, on the sides facing the interior of the cylinder tube. These fixing grooves preferably exhibit additional fixing edges on the opposing sides to secure a correspondingly designed outer band. As a result, these side fixing grooves can simultaneously accommodate an outer band that covers the longitudinal slot from outside to prevent dirt, foreign objects and the like from getting inside. This outer band is essentially identical or similar in designed to the inside sealing tape and arranged laterally reversed to the latter.

In a design with separate grooves provided essentially parallel next to the longitudinal slot, a further embodiment of the invention can provide that the side walls of the fixing grooves be undercut on the side facing away from the longitudinal slot, or preferably even on both sides, near the floor of the groove. The transition from fixing groove to undercut forms the fixing edge that interacts with the accompanying fixing element of the fixing strip. As a result, the sealing tape is very reliably secured with a positive fit near the two longitudinally extended sealing areas.

In another advantageous further development of the invention for fixing edges formed on the outer band, the outer band is divided in a longitudinal direction, and the sealing tape is held in between with the fixing strip. As a result, the longitudinal slot is sealed on the outside, and the inner sealing tape is secured. In this regard, no more additional precautions need to be met on the longitudinal slot.

In another preferred further development of the invention, the sealing tape along with, advantageously, the outer band preferably consist of plastic, with at least the sealing strip of the sealing tape exhibiting inserted or simultaneously formed linear reinforcements extending in the longitudinal direction, preferably made out of steel wire or kevlar fibers. This makes it possible to manufacture the sealing tape and outer band in accordance with practical requirements.

In the following, the invention will be explained in greater detail based on the practical examples in part schematically shown in the drawings.

DETAILED DESCRIPTION OF THE PREFERRED EMBODIMENTS

Figure 1:
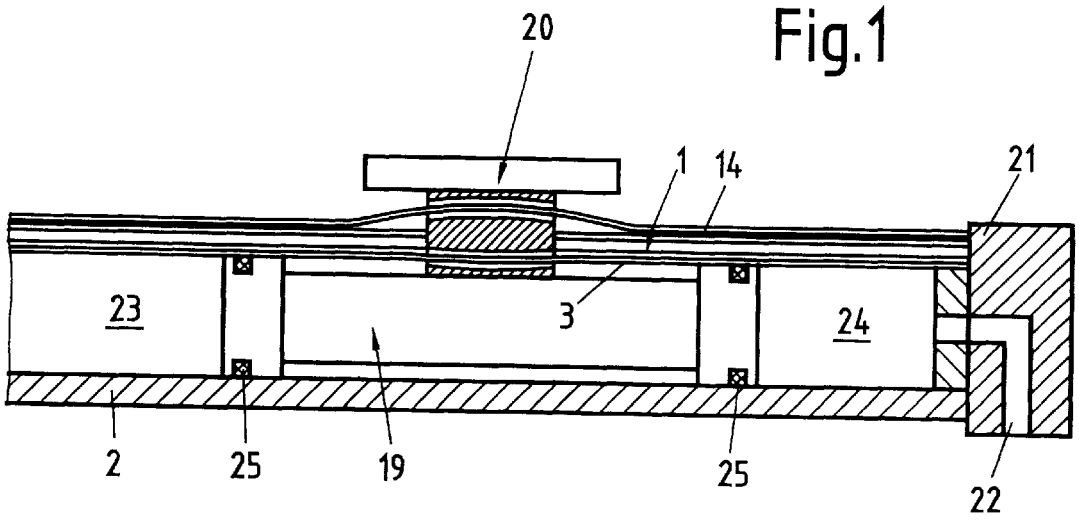
FIG. 1 shows an area-by-area longitudinal section through a pneumatic cylinder according to the invention.

The piston rod-less pneumatic cylinder according to FIG. 1 includes a piston 19 longitudinally moveable inside a cylinder tube 2, and a transmission element 20 that engages with this piston and projects out through a longitudinal slot 1 in cylinder tube 2. Also provided is a sealing tape 3 that seals longitudinal slot 1 from the inside on either side of piston 19, which in the area of transmission element 20 is routed through the latter or piston 19. Longitudinal slot 1 is covered on the outside by an outer band 14, which in the area of transmission element 20 is also routed through the latter. Sealing tape 3 and outer band 14 are secured in the area of lids 21 that tightly seal cylinder tube 2 on either side, wherein these lids 21 also include feed lines 22 for the pressure medium The force exerted on the piston 19 by the pressure medium is conveyed from the transmission element 20 that engages with the piston and projects out through the lateral longitudinal slot 1 to a device to be operated (not shown). Delivery chambers 23 and 24 lying on either side of piston 19 are sealed off by packing rings 25 on piston 19 on the one hand, and by sealing tape 3 covering longitudinal slot 1 from the inside on the other hand, which is routed toward the inside under transmission element 20 or through piston 19 in the unpressurized area between packing rings 25.

Figure 2:
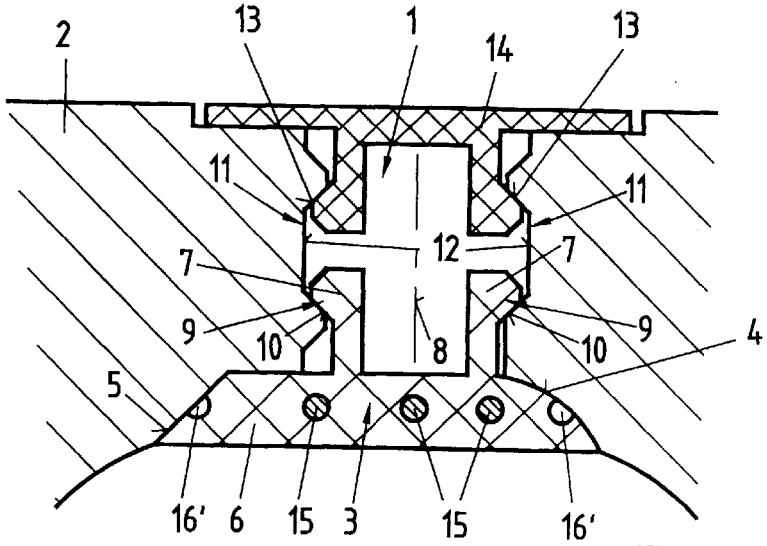
FIGS. 2 to 8 show detailed sections in the area of the longitudinal slot of the cylinder tube for respectively different potential embodiments.

As evident from the embodiment according to FIG. 2, the sealing tape 3 covering the longitudinal slot 1 in cylinder tube 2 from the inside includes a sealing strip 6 that interacts with two longitudinally-extending sealing areas 4, 5 near the end of longitudinal slot 1 inside the cylinder, along with two fixing strips 7 arranged on the outside of sealing strip 6 with two fixing elements 9 that lie opposite one another relative to center plane 8 of longitudinal slot 1, and are essentially longitudinally extended and directed toward the outside. The fixing elements 9 of fixing strips 7 engage in stationary fixing edges 10 formed in longitudinal slot 1 itself to secure sealing tape 3 in longitudinal slot 1 with a positive fit. As a result, sealing areas 4, 5 form a seal against sealing tape 3 even given an unpressurized interior, and initial leaks are prevented during the pressurization of the interior.

Fixing edges 10 are here formed by fixing grooves 12 provided on both sides in the side walls 11 of longitudinal slot 1 on the sides facing the interior of the cylinder tube 2. These fixing grooves provide additional fixing edges 13 on their sides located opposite fixing edges 10 to secure a correspondingly designed outer band 14. This outer band 14 covers the longitudinal slot 1 from outside, and thereby, for example, prevents foreign objects or dirt from getting into longitudinal slot 1.

Sealing tape 3 and outer band 14 preferably consist of plastic, for example polyurethane, wherein sealing strip 6 of sealing tape 3 here includes inserted or simultaneously formed linear reinforcements 15 extending in the longitudinal direction, preferably made out of steel wire or para-aramed fibers sold by E. I. Dupond de Neumours & Co. under the trademark Kevlar. To complete the picture, reference must also be made to side grooves 16' of sealing strip 6 near sealing areas 4, 5, which enable or facilitate a separate processing of corresponding surfaces on sealing strip 6 to improve the sealing action on the side facing the interior of the cylinder.

Figure 3:
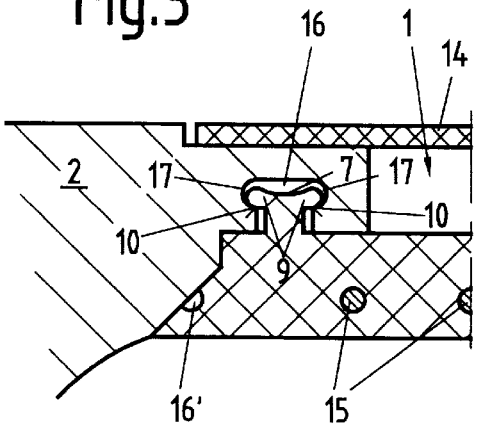

In the embodiment shown in FIG. 3, stationary fixing edges 10 in cylinder tube 2 are arranged on separate fixing grooves 16 of cylinder tube 2 provided on the interior on either side, parallel next to longitudinal slot 1. The side walls of these fixing grooves 16 are here undercut on both sides near the floor of the groove, while the transition from fixing groove 16 to undercut 17 forms the fixing edge 10 that interacts with the accompanying fixing element 9 of fixing strip 7. Outer band 14 is here only indicated schematically, and shown without separate mounting device. To avoid repetition, reference is made to FIG. 2 with regard to the other features and elements not separately addressed here.

Figure 4:
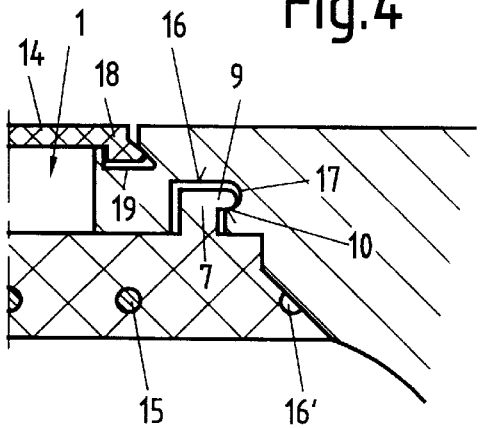

Essentially, the embodiment according to FIG. 4 differs from that in FIG. 3 only in that the side walls of fixing grooves 16 only exhibit an undercut 17 on the side facing away from longitudinal slot 1, into which the respective fixing element 9 of fixing strip 7 engages or where it abuts the corresponding fixing edge 10. Outer band 14 is here provided with fixing lips 18, which engage outside fixing grooves 19. Otherwise, that which was mentioned about embodiments in FIG. 2 and 3 again applies here.

Figure 5:
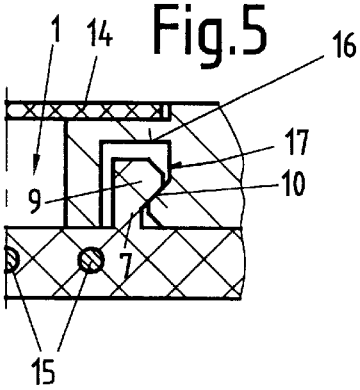

In FIG. 5 as well, separate side fixing grooves 16 are also provided next to longitudinal slot 1, which exhibit undercuts 17 similar to those in FIG. 4, on which fixing edges 10 are formed for interaction with fixing elements 9 on fixing strips 7. As in FIG. 3, only an indication is made here of outer band 14.

Figure 6:
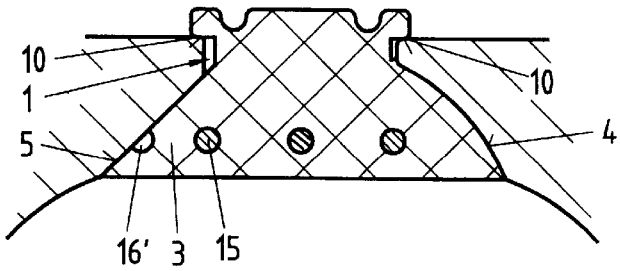

In FIG. 6, fixing edges 10 are directly formed by the outside edges of longitudinal slot 1, wherein longitudinal slot 1 is here practically filled out by sealing tape 3, thereby eliminating the need for a separate outer band.

As in the right side of the depiction in FIG. 2, the right side of the depiction on FIG. 6 indicates that the sealing area 4 can be bent as desired (concave or convex), in contrast to the straight design shown on the left side. This makes it possible to exert a wide variety of influences on the seal or additional mounting device in the longitudinal slot.

Figure 7:
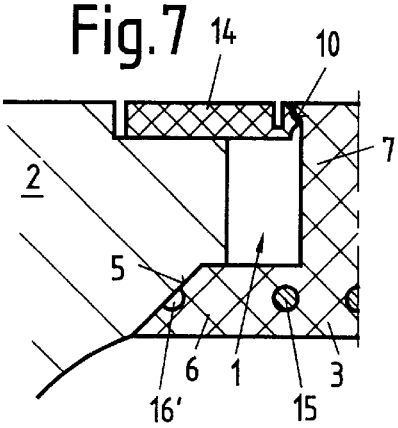

In FIG. 7, fixing edges 10 are provided on outer band 14, which at least partially covers longitudinal slot 1 from outside, wherein this outer band is divided in a longitudinal direction. As a result, sealing tape 3 is held in between with the individual fixing strip 7, which is here in the center.

Figure 8:
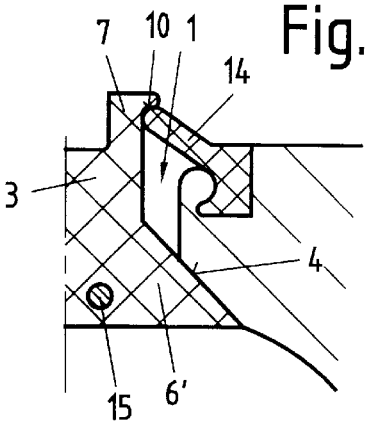

FIG. 8 also shows an outer band 14 divided in a longitudinal direction, which interacts with two side fixing strips 7 of sealing tape 3.

Naturally, outer bands 14 according to FIG. 7 and 8 do not have to be routed through transmission element 20 in the manner indicated in FIG. 1, since they are longitudinally divided, and hence transmission element 20 can easily glide in between.

Therefore, in all described embodiments, the sealing tape 3 in longitudinal slot 1 is secured with a positive fit on fixing edges 10 provided on the cylinder, which makes it possible to reliably secure and seal the respective interior of the cylinder, even in an unpressurized state.

What is claimed is:

1. A piston rod-less pneumatic cylinder which comprises:

a cylinder tube which has a longitudinal slot extending from an outer surface to an inner surface thereof, first and second walls of said cylinder tube providing said longitudinal slot defining longitudinally-extending sealing areas at respective inner portions thereof, said first wall including a longitudinal groove which provides first and second fixing edges located nearer said inner tube surface and said outer tube surface, respectively, a piston located in said cylinder tube and longitudinally movable therein, a transmission element located outside said cylinder tube and connected through said longitudinal slot to said piston to be longitudinally movable with said piston, a sealing tape positioned in said cylinder tube to seal said longitudinal slot longitudinally of a location of said piston, said sealing tape including a longitudinal sealing strip which is positionable against said longitudinal sealing areas of said first and second walls of said cylinder tube, and a first longitudinal fixing strip which extends from said longitudinal sealing strip into said slot, said first longitudinal fixing strip including a first longitudinal fixing element for abutting said first fixing edge so as to retain said sealing strip positioned against said longitudinal sealing areas, and an outer band located on the outer side of said cylinder tube to seal said longitudinal slot in a longitudinal direction, said outer band including a second longitudinal fixing strip which extends into said slot, said second longitudinal fixing strip including a second longitudinal fixing element for abutting said second fixing edge so as to retain said outer band in sealing contact with said cylinder tube.

said sealing tape and said outer band passing through channels in said piston.

2. The piston rod-less pneumatic cylinder of claim 1, wherein said second wall of said cylinder tube includes a longitudinal groove which provides third and fourth fixing edges located nearer said inner tube surface and said outer tube surface, respectively, and wherein said sealing tape includes a third longitudinal fixing element for abutting said third fixing edge so as to help retain said sealing strip positioned against said longitudinal sealing areas.

3. The piston rod-less pneumatic cylinder of claim 2, wherein said outer band includes a fourth longitudinal fixing element for abutting said fourth fixing edge so as to help retain said outer band positioned in sealing contact with cylinder tube.

4. The piston rod-less pneumatic cylinder of claim 2, wherein said sealing tape is made of flexible plastic containing linear reinforcing elements.

5. The piston rod-less pneumatic cylinder of claim 4, wherein said linear reinforcing elements are steel wires.

6. The piston rod-less pneumatic cylinder of claim 4, wherein said linear reinforcing elements are para-aramid fibers.

7. The piston rod-less pneumatic cylinder of claim 2, wherein said sealing tape includes a third longitudinal fixing strip spaced from said first longitudinal fixing strip, and said third longitudinal fixing element is connected to said third longitudinal fixing strip.

8. The piston rod-less pneumatic cylinder of claim 7, wherein said first and third longitudinal fixing elements extend in opposite directions relative to a radial plane extendidng through said longitudinal slot.

9. The piston rod-less pneumatic cylinder of claim 3, wherein said outer band includes a fourth longitudinal fixing strip spaced from said second longitudinal fixing strip, and said fourth fixing element is connected to said fourth longitudinal fixing strip.

10. The piston rod-less pneumatic cylinder of claim 9, wherein said second and fourth longitudinal fixing elements extend in opposite directions relative to a radial plane extending through said longitudinal slot.

* * * * *